US005755508A

United States Patent [19]

Wheaton

[11] Patent Number: 5,755,508

[45] Date of Patent: May 26, 1998

[54] LIGHTED DISPLAY BOARD

[76] Inventor: Richard F. Wheaton, 96 Danforth St. Unit 51, Taunton, Mass. 02780

[21] Appl. No.: 762,278

[22] Filed: Dec. 9, 1996

[51] Int. Cl.[6] ..... F21V 21/00

[52] U.S. Cl. ..... 362/249; 362/234; 362/806

[58] Field of Search ..... 362/227, 234, 362/237, 242, 246, 249, 252, 437, 443, 440, 806

[56] References Cited

U.S. PATENT DOCUMENTS 2,815,439 12/1957 Plubell ..... 362/806

4,577,264 3/1986 Plumly ..... 362/252

5,303,490 4/1994 Yang ..... 362/234

*Primary Examiner*—Y My Quach

[57] ABSTRACT

A new Lighted Display Board which provides an illuminated surface on which figures and other forms of ornaments may be placed upon. The inventive device includes a display board, a plurality of apertures in the board, a plurality of aperture covers, a plurality of sockets, a plurality of socket fixtures, a corresponding number of light bulbs, a plurality of electric wires, and a male plug.

12 Claims, 3 Drawing Sheets

18
40
20
44

60
64
62
18
40
20

LIGHTED DISPLAY BOARD

BACKGROUND OF THE INVENTION

1. Field of the Invention

The present invention relates to a board that is illuminated by a number of light bulbs and more particularly pertains to a new Lighted Display Board used to provide an illuminated surface on which ornaments, figures and other forms may be placed upon for decorative purposes.

2. Description of the Prior Art

The use of boards that are illuminated by a number of light bulbs is known in the prior art. More specifically, boards that are illuminated by a number of light bulbs heretofore devised and utilized are known to consist basically of familiar, expected and obvious structural configurations, notwithstanding the myriad of designs encompassed by the crowded prior art which have been developed for the fulfillment of countless objectives and requirements.

Known prior art boards that are illuminated by a number of light bulbs include U.S. Pat. No. 5,348,478; U.S. Pat. No. 5,010,463; U.S. Pat. No. 5,297,484; U.S. Pat. No. 5,002,513; U.S. Pat. No. 4,051,783 and U.S. Pat. No. 5,370,460

While these devices fulfill their respective, particular objectives and requirements, the aforementioned patents do not disclose a new Lighted Display Board. The inventive device includes a display board, a plurality of apertures in the board, a plurality of aperture covers, a plurality of sockets, a plurality of socket fixtures, a corresponding number of light bulbs, a plurality of electric wires, and a male plug.

In these respects, the Lighted Display Board according to the present invention substantially departs from the conventional concepts and designs of the prior art, and in so doing provides an apparatus primarily developed for the purpose of providing a lighted surface on which ornaments, figures and other forms may be placed for decorative purposes.

SUMMARY OF THE INVENTION

In view of the foregoing disadvantages inherent in the known types of a board that is illuminated by a number of light bulbs now present in the prior art, the present invention provides a new Lighted Display Board construction wherein the same can be utilized to provide a lighted surface on which figures and other forms of decorations may be placed for decorative purposes.

The general purpose of the present invention, which will be described subsequently in greater detail, is to provide a new Lighted Display Board apparatus and method which has many of the advantages of a board that is illuminated by a number of light bulbs mentioned heretofore and many novel features that result in a new Lighted Display Board which is not anticipated, rendered obvious, suggested, or even implied by any of the prior art, a board that is illuminated by a number of light bulbs, either alone or in any combination thereof.

To attain this, the present invention generally comprises a display board, a plurality of apertures in the board, a plurality of aperture covers, a plurality of sockets, a plurality of socket fixtures, a corresponding number of light bulbs, a plurality of electric wires, and a male plug.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a New Lighted Display Board apparatus and method which has many of the advantages of the boards that are illuminated by a number of light bulbs mentioned heretofore and many novel features that result in a new Lighted Display Board which is not anticipated, rendered obvious, suggested, or even implied by any of the prior art boards that are illuminated by a number of light bulbs, either alone or in any combination thereof.

It is another object of the present invention to provide a new Lighted Display Board which may be easily and efficiently manufactured and marketed.

It is a further object of the present invention to provide a new Lighted Display Board which is of a durable and reliable construction.

An even further object of the present invention is to provide a new Lighted Display Board which is susceptible of a low cost of manufacture with regard to both materials and labor, and which accordingly is then susceptible of low prices of sale to the consuming public, thereby making such Lighted Display Board economically available to the buying public.

Still yet another object of the present invention is to provide a new Lighted Display Board which provides in the apparatuses and methods of the prior art some of the advantages thereof, while simultaneously overcoming some of the disadvantages normally associated therewith.

Still another object of the present invention is to provide a new Lighted Display Board for to provide a lighted surface on which ornaments, figures and other forms may be placed upon for decorative purposes.

Yet another object of the present invention is to provide a new Lighted Display Board which includes a display board, a plurality of apertures in the board, a plurality of aperture covers, a plurality of sockets, a plurality of socket fixtures, a corresponding number of light bulbs, a plurality of electric wires, and a male plug.

Still yet another object of the present invention is to provide a new Lighted Display Board that provides for the illuminated display of holiday ornaments by consolidating the use of many wires and male plugs into one to provide a safer display.

Even still another object of the present invention is to provide a new Lighted Display Board that allows users to be versatile and to easily display individual or sets of ornaments and other forms for occasions such as Christmas, Valentine's day, Halloween and so forth.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
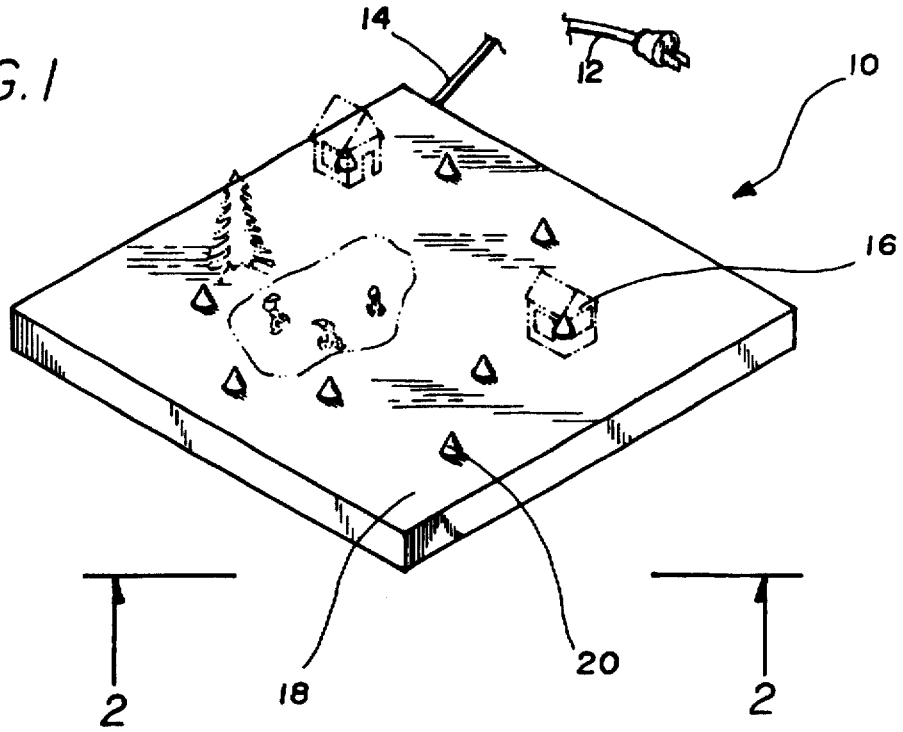
FIG. 1 is a right side perspective view of a new Lighted Display Board according to the present invention.
Figure 2:
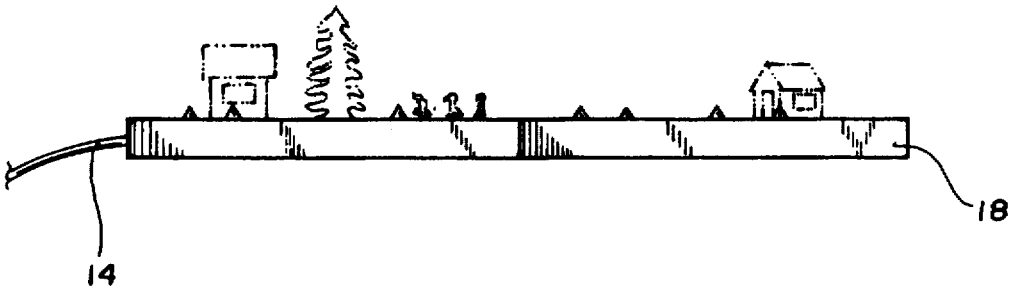
FIG. 2 is a side elevation view thereof.
Figure 3:
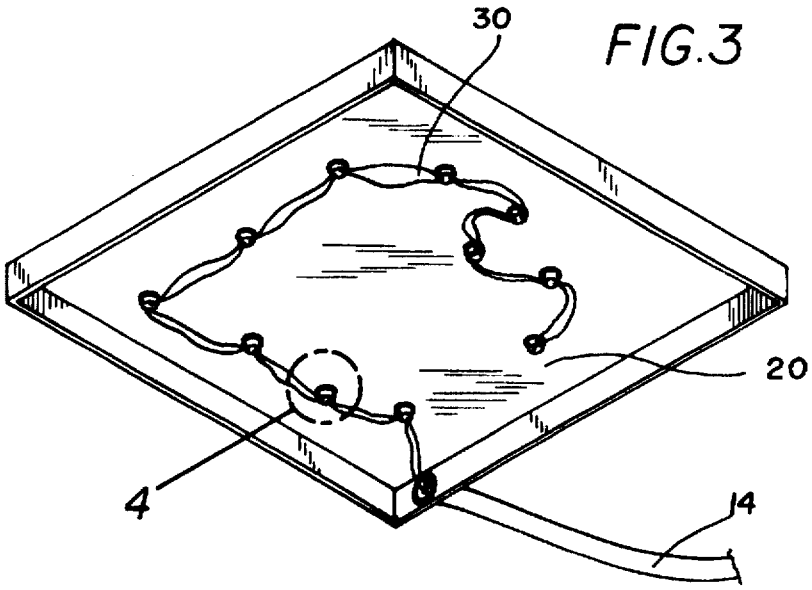
FIG. 3 is a rear elevation view of the invention.
Figure 4:
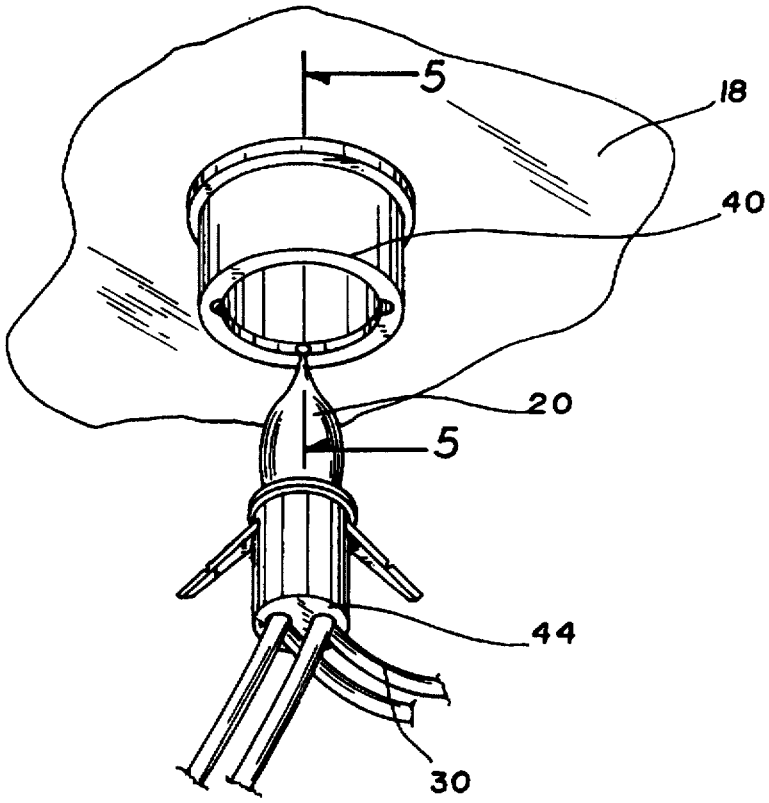
FIG. 4 is an exploded isometric illustration of the present invention.
Figure 5:
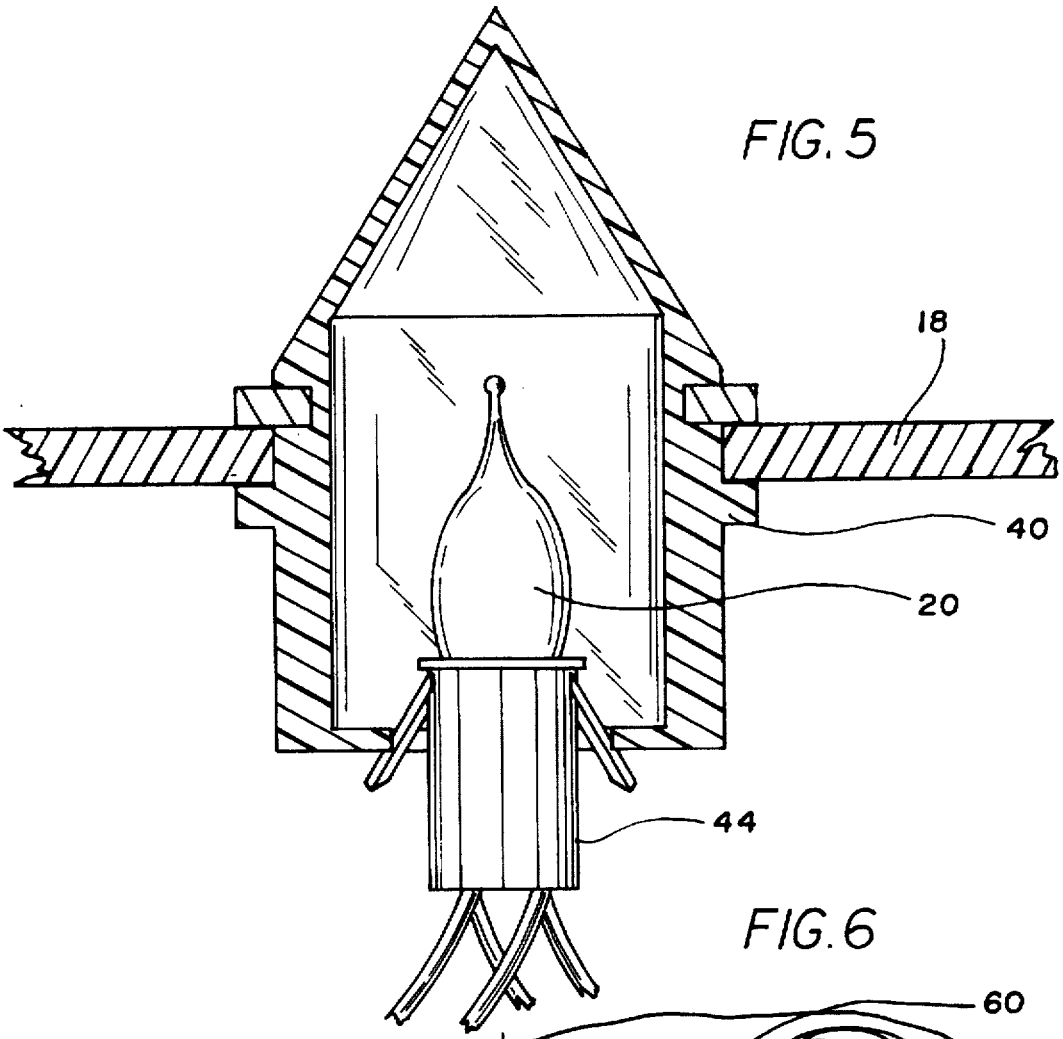
FIG. 5 is a cross sectional view of the lighting fixture of the present invention.
Figure 6:
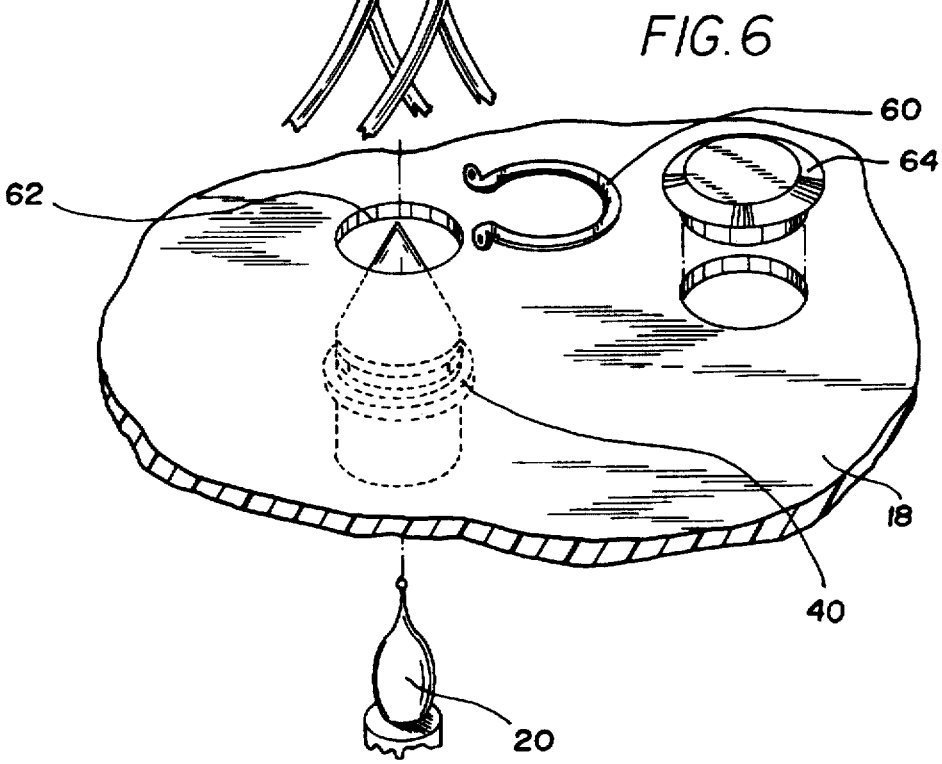
FIG. 6 is a cross sectional view taken along line 2—2 of FIG. 1.

With reference now to the drawings, and in particular to FIGS. 1 through 6 thereof, a new Lighted Display Board embodying the principles and concepts of the present invention and generally designated by the reference numeral 10 will be described.

More specifically, it will be noted that the Lighted Display Board 10 comprise a display board, a plurality of apertures in the board, a plurality of aperture covers, a plurality of sockets, a plurality of socket fixtures, a corresponding number of light bulbs, a plurality of electric wires, and a male plug.

As best illustrated in FIGS. 1 through 6, it can be shown that the present invention provides a new Lighted Display Board apparatus and method which has many of the advantages of the a board that is illuminated by a number of light bulbs mentioned heretofore and many novel features that result in a new Lighted Display Board which is not anticipated, rendered obvious, suggested, or even implied by any of the prior art, a board that is illuminated by a number of light bulbs, either alone or in any combination thereof.

In use, the present invention includes a display board 18, a plurality of apertures in the board 62, a plurality of aperture covers 64, a plurality of sockets 44, a plurality of socket fixtures 40, a corresponding number of light bulbs 20, a plurality of electric wires 30, and a male plug 12. The board 18, can be made of wood but preferably it is made of plastic. The board 18 may be of any shape or size including but not limited to being round, square, or multi-sided to provide various designs. However, the preferred embodiment is a square board which is about 36 inches by 36 inches by 2½ inches. The apertures 62 are made of a size necessary to hold a light bulb 20 that is about 4 watts and they are available for the light bulbs 20 to be inserted into the board 18 with a retaining means 60 used to hold the socket fixture 40 in place on the board 18. The light bulbs 20 can be of any shape, color or make but should be of a low enough wattage bulb to accommodate the ornaments. Preferably 4 watts bulbs are used. On the underside of the board 18, the wires 30 are connected to the sockets 44 which are in turn coupled into an electric chord 14. The chord 14 is connected to a man plug 12 that generally plugs into a standard wall outlet.

The means of putting together the new Lighted Display Board is as follows; several aperatures 62 are made in the board in varying positions. The bulbs 20 are inserted into sockets 44. The socket 44 with the bulb 20 are drawn through the aperature 62 and an aperture cover 64 is placed over the bulb 20. The aperture cover 64 can be any shape but is preferably round and made of glass or clear plastic or any suitable material that allows the radiance of the bulbs 20 to shine through. A retaining means 60 holds the system in place. The retaining means 60 can be any shape depending on the shape of the apertures 62 and aperture covers 64. Preferably, the retaining means 60 is horse-shoe shaped. The ornaments 16 are generally figures, articles and so forth used at various holidays, can be placed on the aperture covers 64 prior to plugging in the man plug 12 into an electrical outlet or they can be placed after the bulbs 20 are lit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lighted display board system comprising:

a display board having front display surface and a rear surface, said display board having a plurality of apertures therein, a plurality of socket fixtures each configured to be removably mounted in a said aperture;

a plurality of light sockets for receiving light bulbs and being fit into said socket fixtures;

a corresponding number of light bulbs for mounting in said sockets;

a plurality of electric wires electrically connecting each said socket together;

an electric cord connected to said plurality of wires;

at least one aperture cover covering an aperture in said display board not having a socket fixture mounted therein to permit removal of socket fixtures from selected apertures without leaving a void in said display board; and a plurality of retaining means each holding a said socket fixture in place on the display board.

2. The lighted display board system of claim 1 wherein said display board is rectangular.

3. The lighted display board system of claim 1 wherein the display board is about 36 inches by 36 inches by 2½ inches.

4. The lighted display board system of claim 1 wherein the display board comprises plastic.

5. The lighted display board system of claim 1 wherein the display board comprises wood.

6. The lighted display board system of claim 1 additionally comprising a plurality of ornaments each configured to be mounted on a said socket fixture, each said ornament having a translucent portion for permitting light from said light bulb to be transmitted through the translucent portion of said ornament.

7. The lighted display board system of claim 1 wherein the apertures are substantially round.

8. The lighted display board of claim 1 wherein each said retaining means comprises a spring clip which engages a groove in said socket fixture.

9. The lighted display board system of claim 1 wherein each said socket fixture has a cylindrical portion with an annular collar thereabout for abutting against the rear surface of the display board to position the socket fixture in a said aperture.

10. The lighted display board system of claim 9 wherein each said retaining means comprises a spring clip, and wherein each said socket fixture has an annular groove therein axially spaced from said annular collar for receiving said spring clip such that said spring clip holds said annular collar against said display board located between said annular collar and said spring clip.

11. The lighted display board system of claim 1 wherein each said socket fixture has a cylindrical portion and a conical portion, said cylindrical portion configured to fit in a said aperture in said display board such that said conical portion protrudes from the front display surface of said display board for being received in an ornament.

12. A lighted display board system comprising:

a display board having front display surface and a rear surface, said display board having a plurality of substantially circular apertures therein, a plurality of socket fixtures each configured to be mounted in a said aperture;

a plurality of light sockets for receiving light bulbs and being fit into said socket fixtures;

a corresponding number of light bulbs for mounting in said sockets;

a plurality of electric wires electrically connecting each said socket together;

an electric cord connected to said plurality of wires;

at least one aperture cover for covering an aperture in said display board not having a socket fixture mounted therein to permit removal of socket fixtures from selected apertures without leaving a void in said display board; and a plurality of retaining means each being for holding a said socket fixture in place on the display board; and a plurality of ornaments each being configured to be mounted on a said socket fixture, each said ornament having a translucent portion for permitting light from said light bulb to be transmitted through the translucent portion of said ornament;

wherein each said socket fixture has a cylindrical portion and a conical portion, said cylindrical portion being configured to fit in a said aperture in said display board and having an annular collar thereabout for abutting against the rear surface of the display board to position the socket fixture in a said aperture, said conical portion protruding from the front display surface of said display board for being received in said ornament; and wherein each said retaining means comprises a spring clip, and wherein each said socket fixture has an annular groove therein axially spaced from said annular collar for receiving said spring clip such that said spring clip holds said annular collar against said display board located between said annular collar and said spring clip.

* * * * *